US005699580A

United States Patent [19]

Silverstein

[11] Patent Number: 5,699,580

[45] Date of Patent: Dec. 23, 1997

[54] ADJUSTABLE TROWEL AND METHOD OF PRODUCING

[76] Inventor: Mike Silverstein, P.O. Box 3381, Eilat 88000, Israel

[21] Appl. No.: 572,445

[22] Filed: Dec. 14, 1995

[51] Int. Cl.[6] ..... B05C 17/10

[52] U.S. Cl. ..... 15/235.7; 15/235.8; 15/236.01; 15/236.09; 425/458; D8/45; 29/434; 29/525.02

[58] Field of Search ..... 15/235.3–235.8, 15/236.01, 236.05–236.09, 245.1; 425/458; D8/45; 30/169, 171, 172, 320, 321; 29/434, 525.02

[56] References Cited

U.S. PATENT DOCUMENTS

| | | | |
|---|---|---|---|
| 109,073 | 11/1870 | Streeter . | |
| D. 323,271 | 1/1992 | Barenthsen | D8/45 |
| 398,781 | 2/1889 | Hovey . | |
| 684,576 | 10/1901 | Lucas . | |
| 1,370,060 | 3/1921 | Smith . | |
| 1,383,688 | 7/1921 | Word . | |
| 1,529,309 | 3/1925 | Hoegberg | 30/169 X |
| 1,605,305 | 11/1926 | Vinje | 30/169 X |
| 1,940,169 | 12/1933 | Hinton | 30/321 X |
| 2,178,899 | 11/1939 | Shaffer . | |
| 2,595,742 | 5/1952 | Wood . | |
| 2,608,853 | 9/1952 | Schrepper . | |
| 4,619,013 | 10/1986 | Yon | 15/235.8 |
| 5,442,832 | 8/1995 | Tonsager | 15/235.7 |
| 5,544,384 | 8/1996 | Forselius et al. | 15/235.7 |

*Primary Examiner*—Mark Spisich

[57] ABSTRACT

An adjustable trowel which is suitable for both internal and external abutting comers is provided. The trowel includes first and second blade members, each having a plurality of arcuate slots formed therein and a blade angle between the sides of the blade members; and a handle member cooperating with the arcuate slots for releasably locking the blade members together with a desired angle between the sides of the blade members.

10 Claims, 3 Drawing Sheets

ADJUSTABLE TROWEL AND METHOD OF PRODUCING

FIELD OF THE INVENTION

The present invention relates to building industry tools and more specifically to a trowel-type tool for use in applying and smoothing of mortar, plaster etc. especially in comers and intersections.

BACKGROUND OF THE INVENTION

Various hand tools exist for applying and smoothing out wet plastering, or joint compound used in dry wall or gypsum board panels. Where the joint to be finished is between two panels lying in the same plane, a planar trowel is commonly used. It generally comprises a thin steel rectangular sheet having a handle affixed thereto or a relatively wide putty knife. Where the two sheets of dry wall meet at a right angle, there are also available a trowel comprising a thin sheet metal member that is bent along a mid-line to define two planar surfaces meeting at a fixed 90 degree angle. Again, a handle is affixed to the sheet metal member to facilitate the positioning of the trowel in a corner joint and drawing it along the joint as joint compound is applied.

Numerous tools have been devised with the aim of providing a device which is simple to adjust and use, and inexpensive to manufacture. For example, U.S. Pat. Nos. 1,370,060 to Smith; 2,595,742 to Wood; 2,608,853 to Schrepper and 4,619,013 to Yon describe adjustable trowels which are however limited to use in internal comers. Trowels and smoothing tools for use with external comers are also known in the art.

Because of the difficulty of positioning a trowel in sharply defined internal comers and since the standard trowel which is used for such comers is not suitable for external comers, it is common in the trade to use at least two different tools for internal and external comers.

Since, in many instances, walls are not oriented only at 180 degrees and at 90 degrees relative to one another, a tradesman needs to carry several trowels for accommodating a wide variety of angles. It, therefore, would be advantageous to have a single trowel for applying plastering or dry wall joint compound that is adjustable so that it can be used in creating a smooth, visually imperceptive joint between abutting surfaces intersecting at a variety of angles. It would be a further advantage to have a single tool which could be used for both internal and external angles.

SUMMARY OF THE PRESENT INVENTION

It is an object of the present invention to provide an adjustable trowel which suitable for both internal and external abutting comers.

There is therefore provided, in accordance with a preferred embodiment of the present invention, an adjustable trowel which includes first and second blade members and handle means. Each of the first and second blade members have a first and a second side defining a blade angle therebetween and also have a plurality of arcuate slots formed therethrough. The handle means cooperate with the arcuate slots for releasably locking the blade members together so that there is a desired angle between the second sides of the blade members.

Furthermore, in accordance with a preferred embodiment of the invention there is provided an adjustable trowel which includes an interchangeable blade member having a plurality of arcuate slots formed therein and handle means cooperating with the arcuate slots for releasably locking the interchangeable blade member to the handle means.

Furthermore, in accordance with a preferred embodiment of the invention, the desired angle may be an internal or external angle. In addition, in accordance with a preferred embodiment of the invention, the desired angle can be 180° so that the adjustable trowel can be used as a flat spatula.

Additionally, in accordance with a preferred embodiment of the invention, the handle means includes a plurality of threaded bolts dimensioned to pass through the arcuate slots in the blade members when aligned and a plurality of nuts adapted to be screwed onto the threaded bolts for affixing the handle means to the blade members.

Furthermore, in accordance with a preferred embodiment of the invention, the blade members are generally triangular in shape and furthermore, the shape may be an isosceles triangular shape.

Finally, in accordance with a preferred embodiment of the invention, a method for producing an adjustable trowel is also provided which includes the steps of connecting a first blade member to a second blade member and connecting handle means to the first and second blade member. The handle means cooperate with arcuate slots in the first and second blade members, for selectively releasably locking the first and second blade members together with a desired angle between the second sides of the first and second blade members.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1:
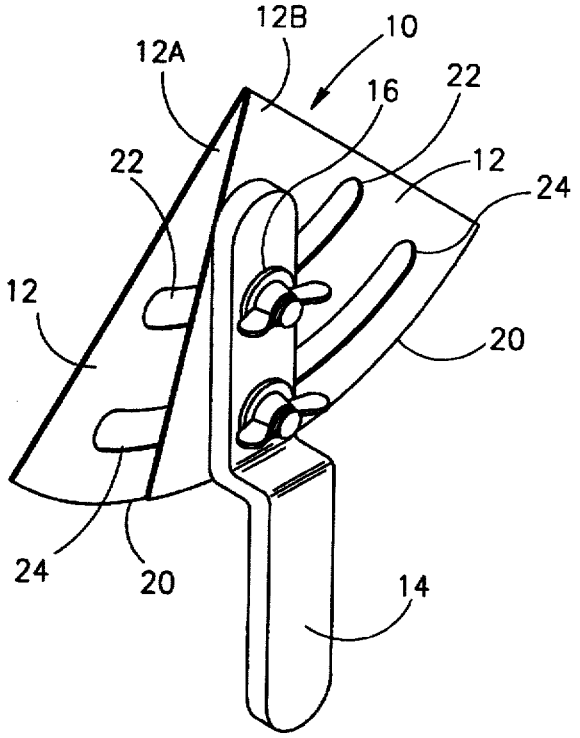
FIG. 1 is a perspective view of the adjustable trowel, constructed and operative in accordance with an embodiment of the present invention.
Figure 2:
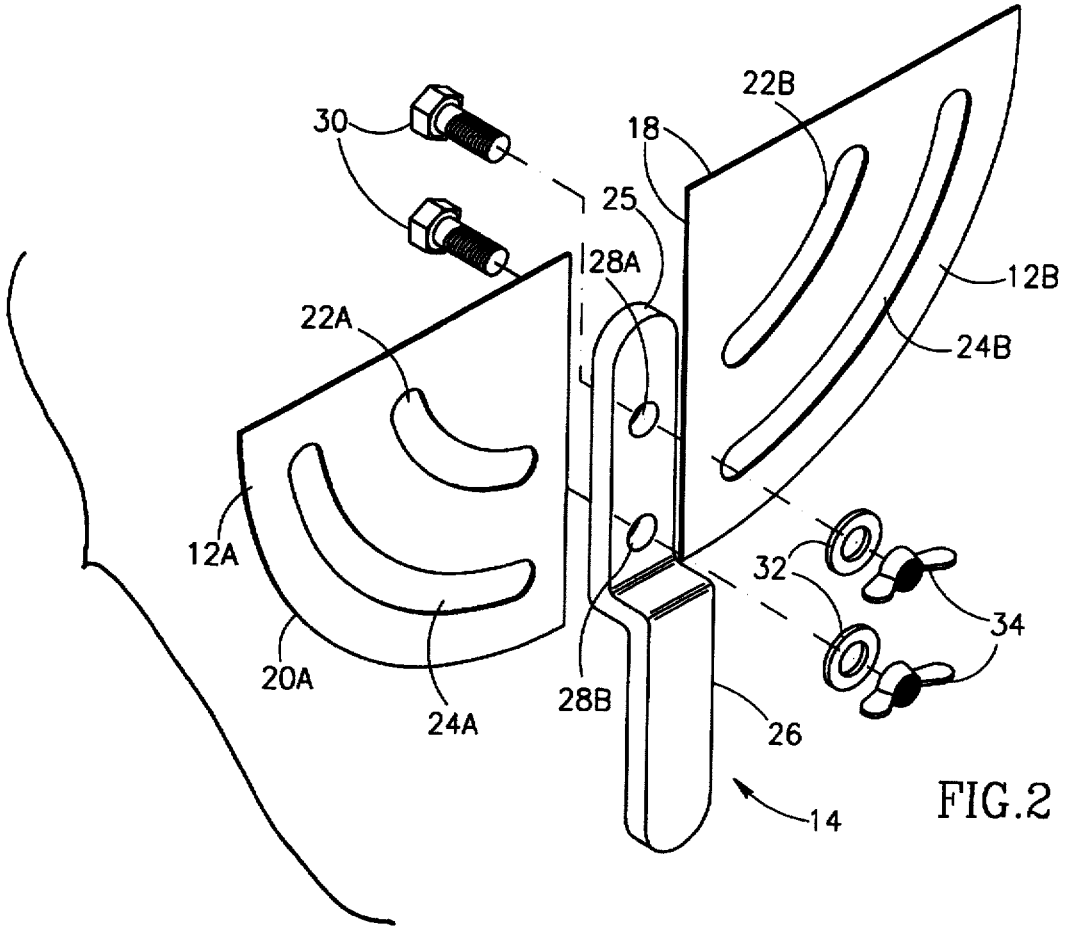
FIG. 2 is an exploded view of the trowel of FIG. 1.

Reference is made to FIGS. 1 and 2 which illustrate an adjustable trowel, generally indicated 10, constructed and operative in accordance with an embodiment of the present invention.

Adjustable trowel 10 generally comprises identically shaped first and second blade members, generally designated 12 and individually designated **12*a* and 12*b*, respectively connected to each other and to a handle 14. Handle 14 is secured to the blade members 12*a* and 12*b*, by a bolt and nut arrangement, generally designated 16. Blade members 12 are adjusted by slightly loosening the bolt and nut arrangement 16** and adjusting the intersection angle $\alpha$ to the desired angle, that is to the angle of the corner being worked on.

Blade members 12 are identical, flat and generally having an isosceles triangular shape with two equal sides 18 and an arcuate hypotenuse 20. First and second arcuate slots 22 and 24 are formed through the thickness of each blade member 12.

Handle 14 is formed from any suitable material such as wood, metal or plastic and comprises a leg portion 25 integrally formed with a hand shaped gripping member 26. First and second bores 28*a* and 28*b* are formed through the leg portion 25. Gripping member 26 is generally shaped to conform to the contours of the hand.

Bolt and nut arrangement 16 comprises first and second bolts 30*a* and 30*b*, which pass through first and second bores 28*a* and 28*b* respectively. A washer 32 and a wing nut 34 or similar, are screwed on to each bolt 30 so that on tightening, blade members 12 are pressed tightly together and prevented from moving.

It will be appreciated by persons skilled in the art that the invention is not limited to a minimum of two blade members but can be used with a single blade member 12. It is an important advantage of the present invention that the tool only comprises one blade or two identical blade members, and a handle element which can be cheaply manufactured and which can be easily combined to form the finished tool.

To prepare the trowel 10 for use for internal angles using two blade members 12, for example, blade members 12*a* and 12*b* respectively are positioned so that the first and second arcuate slots 22*a* and 24*a* of one blade member, say 12*a*, are adjacently aligned with the corresponding first and second arcuate slots 22*b* and 24*b*, respectively, of blade member 12*b*. The leg portion 25 of the handle 14 is then positioned so that the first and second bores 28*a* and 28*b* are aligned with the first and second arcuate slots 22 and 24. In this configuration, arcuate hypotenuses 20*a* and 20*b* are adjacent each other. First and second bolts 30*a* and 30*b* are then inserted passing through first and second bores 28*a* and 28*b* and first and second arcuate slots 22 and 24, respectively. The washer 32 and a wing nut 34 assembly is then screwed onto the bolts 30 and tightened thereby ensuring that the trowel 10 is securely assembled.

Figure 3:
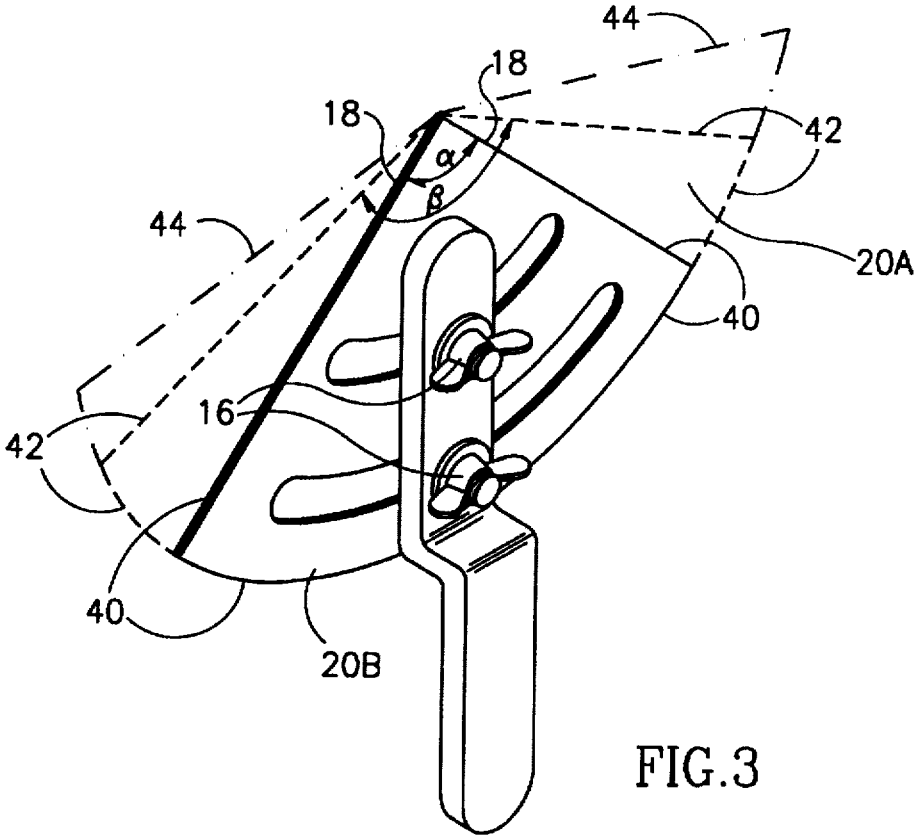
FIG. 3 is a perspective view illustration of alternative arrangements of the blade members of the trowel of FIG. 1.

With reference to FIG. 3, it can be seen that by slightly loosening wing nut 34, the angle of intersection $\alpha$ of blade members 12 can be adjusted. The angle of intersection $\alpha$ can be adjusted between a first limiting position (shown by solid line 40) equal to the angle between the sides 18 (in this example, 90°), to an intermediate position of angle $\beta$ (shown by broken line 42) to a maximum position (hashed line 44). In the latter position shown by line 42, the maximum angle of intersection is approximately 165°.

It will be further appreciated, by persons skilled in the art, that that the shape of blade members 12 is not restricted to an isosceles triangular shape having a 90° right angle between sides 18. For example, using blade members 12 having a 60° angle between sides 18, the intersection angle $\alpha$ can be adjusted between 60° and 110° approximately. Similarly, using blade members 12 having a 120° angle, for example, between sides 18, the intersection angle $\alpha$ can be adjusted between 120° and 230° approximately. Thus, the range of intersection angles is only restricted by the shape of the specific blade members being used and can encompass all possible angles of the circle.

Figure 4:
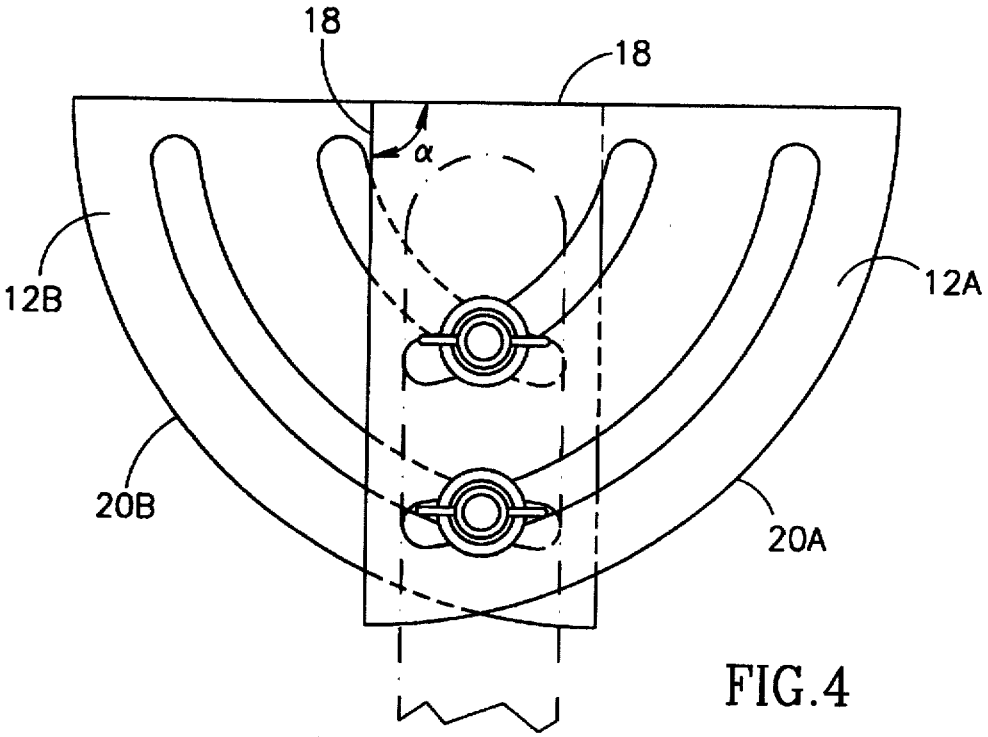
FIGS. 4 and 5 are end view illustrations of alternative arrangements of the blade members of the trowel of FIG. 1.

Reference is now made to FIG. 4, which illustrates an alternative arrangement of blade members 12. Blade members 12 are arranged so that one blade member 12*a* overlays the second blade 12*b* and one of the sides 18 of each of blades 12*a* and 12*b* are adjacent each other and arcuate hypotenuses 20*a* and 20*b* are opposite each other. Handle 14 is then fastened to the blades 12, as described hereinabove with respect to FIGS. 1 and 3. In this configuration, trowel 10 can be used as a flat spatula.

Figure 5:
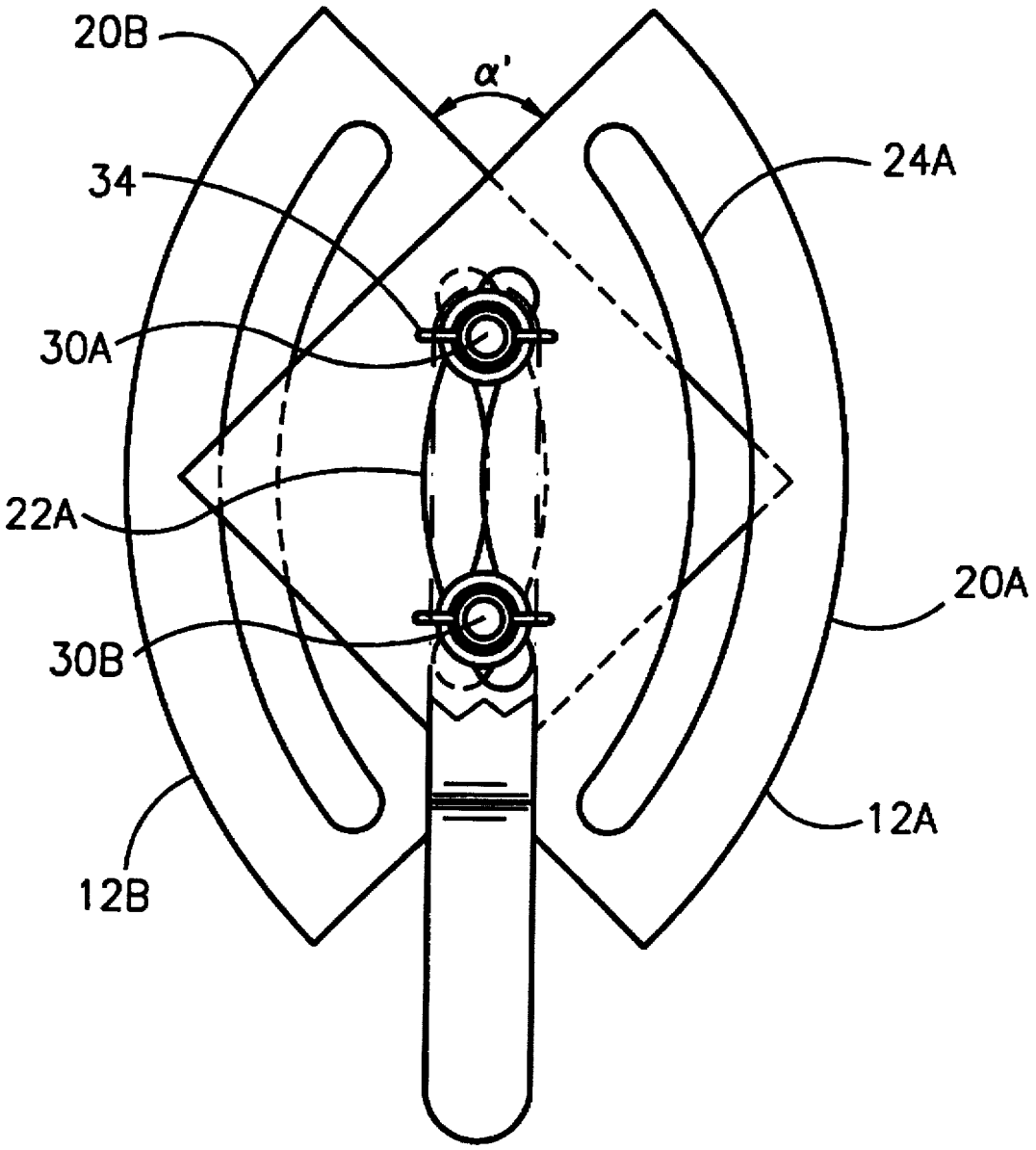

Reference is now made to FIG. 5, which illustrates the use of trowel 10 for external comers. The trowel is assembled in a similar manner to that described hereinabove with respect to FIGS. 1 and 3. However, for external comers, first and second bolts 30*a* and 30*b* are inserted through first and second bores 28*a* and 28*b* of leg portion 25 and arcuate slots 12*a* and 22*b*, of blade members 12*a* and 12*b*, respectively. In this configuration, arcuate hypotenuses 20*a* and 20*b* are opposite each other.

Similar to the embodiment described with respect to FIG. 3, it can be seen that by slightly loosening wing nut 34 and displacing the first blade member 12*a* relative to the second blade 12*b*, the external angle of intersection $\alpha'$ of blade members 12 (having a 90° angle between sides 18), can be adjusted between an angle of 90° and approximately 165°. Furthermore, by using the different shaped blade members the range of external angles of intersection $\alpha'$ can encompass all possible external angles.

It will be appreciated by persons skilled in the art that the present invention may be used as both a finishing tool and also as a plastering trowel. By selectably configuring the blade members, the trowel may be used for both internal and external comers irrespective of the angle of the corner.

It will be further appreciated by persons skilled in the art that the present invention is not limited to what has been particularly shown and described hereinabove. Rather the scope of the present invention is defined only by the claims which follow:

1. An adjustable trowel, comprising:

a. first and second blade members, each of said blade members having first and second sides defining a blade angle therebetween and having a plurality of arcuate slots therethrough;

b. a handle having a gripping portion and a leg portion; and c. means for connecting and securing the blade members to the leg portion of the handle, wherein the blade members are movable relative to each other in mutually parallel planes, the connecting means permitting selective releasable locking of said blade members whereby a desired angle between said second side of said first blade member and said second side of said second blade member may be selectively adjusted.

2. An adjustable trowel according to claim 1 wherein said desired angle is an internal angle.

3. An adjustable trowel according to claim 1 wherein said desired angle is an external angle.

4. An adjustable trowel according to claim 1 wherein said desired angle is 180°.

5. An adjustable trowel according to claim 1 and wherein said connecting and securing means comprises:

a. a plurality of threaded bolts dimensioned to pass through said arcuate slots in said first and second blade members when aligned; and b. a plurality of nuts adapted to be screwed onto said threaded bolts for affixing said first and second blade members to said leg portion.

6. An adjustable trowel according to claim 1 wherein each of said first blade member and said second blade member further comprise a third side and are generally triangular in shape.

7. An adjustable trowel according to claim 1 wherein said first blade member and said second blade member have an isosceles triangular shape.

8. An adjustable trowel according to claim 1 wherein said blade angle is a right angle.

9. An adjustable trowel comprising:

an interchangeable blade member having a plurality of arcuate slots formed therein;

a. a handle having a gripping portion and a leg portion; and b. connecting and securing means for securing the blade member to the leg portion of the handle, wherein the blade member is movable relative to the leg portion in a parallel plane permitting selective releasable locking of said interchangeable blade member to said leg portion; and wherein said connecting and securing means comprises:

i. a plurality of threaded bolts dimensioned to pass through said arcuate slots in said blade member when aligned; and ii. a plurality of nuts adapted to be screwed onto said threaded bolts for affixing said blade member to said leg portion.

10. A method for producing an adjustable trowel comprising the steps of:

a. connecting a first blade member to a second blade member, each of said first blade member and said second blade member having first and second sides defining a blade angle therebetween and having a plurality of arcuate slots therethrough; and b. securing the blade members to a leg portion of a handle by connecting means, said handle also having a gripping portion, wherein the blade members are movable relative to each other in mutually parallel planes said connecting means permitting the selective releasable locking of said first blade member and said second blade member whereby a desired angle between said second side of said first blade member and said second side of said second blade member may be selectively adjusted.

* * * * *